US007802558B2

(12) United States Patent
Panchal

(10) Patent No.: US 7,802,558 B2
(45) Date of Patent: Sep. 28, 2010

(54) FUEL DELIVERY SYSTEM

(75) Inventor: Devan Panchal, Northants (GB)

(73) Assignee: Delphi Technologies Holding S.arl, Troy, MI (US)

( * ) Notice: Subject to any disclaimer, the term of this patent is extended or adjusted under 35 U.S.C. 154(b) by 24 days.

(21) Appl. No.: 12/395,905

(22) Filed: Mar. 2, 2009

(65) Prior Publication Data

US 2009/0255511 A1 Oct. 15, 2009

(30) Foreign Application Priority Data

Mar. 3, 2008 (GB) ..... 0803908.3

(51) Int. Cl.
*F02M 69/46* (2006.01)
*F02M 55/02* (2006.01)

(52) U.S. Cl. ..... 123/456; 123/468

(58) Field of Classification Search ..... 123/456, 123/468, 469, 470

See application file for complete search history.

(56) References Cited

U.S. PATENT DOCUMENTS

| | | | | |
|---|---|---|---|---|
| 2,892,453 | A * | 6/1959 | Stoll | 123/452 |
| 4,526,151 | A * | 7/1985 | Tateishi et al. | 123/468 |
| 5,592,968 | A * | 1/1997 | Nakashima et al. | 137/561 A |
| 6,260,538 | B1 * | 7/2001 | Soteriou | 123/456 |
| 6,298,814 | B1 * | 10/2001 | Pearlman et al. | 123/90.38 |
| 6,314,946 | B1 * | 11/2001 | Funakura et al. | 123/509 |
| 2004/0194761 | A1 | 10/2004 | Ando et al. | |
| 2006/0185649 | A1 | 8/2006 | Muench et al. | |

FOREIGN PATENT DOCUMENTS

| | | |
|---|---|---|
| DE | 19731643 | 9/1998 |
| EP | 1811165 | 7/2007 |

OTHER PUBLICATIONS

European Search Report dated Jul. 9, 2009.

* cited by examiner

*Primary Examiner*—Thomas N Moulis
(74) *Attorney, Agent, or Firm*—Thomas N. Twomey

(57) ABSTRACT

A fuel delivery system for an internal combustion engine, the system comprising a common rail fuel reservoir having a primary rail axis and comprising a plurality of outlets at spaced locations along said rail axis and a plurality of fuel injectors arranged at spaced locations with respect to said rail axis. Each injector comprises an injector inlet, said plurality of fuel injectors defining first and second groups of injectors. The system further comprises first and second groups of pipes of substantially equal length, wherein each of said first group of pipes is of a first common design and connects the injector inlet of one of said first group of fuel injectors to an outlet displaced relative to said one of said first group of fuel injectors in a first direction substantially parallel to said rail axis, and each of said second group of pipes is of a second common design and connects the injector inlet of one of said second group of fuel injectors to an outlet displaced relative to said one of said second group of fuel injectors in a second direction substantially parallel to said rail axis and antiparallel to said first direction. Not more than one of said first group of injectors is disposed adjacent to said second group of injectors.

18 Claims, 4 Drawing Sheets

FUEL DELIVERY SYSTEM

FIELD OF THE INVENTION

The present invention relates to a fuel delivery system and, in particular, to a fuel delivery system for an internal combustion engine.

BACKGROUND OF THE INVENTION

In a known compression-ignition internal combustion engine, such as a diesel engine, combustion takes place in one or more combustion chambers or cylinders. Air is compressed in the cylinder by a piston and fuel is injected into the compressed air. The heat of the compressed air spontaneously ignites the fuel in the cylinder.

In a common rail fuel delivery system, fuel is injected into the cylinders at high pressure, which is typically achieved using a high pressure pump to supply pressurised fuel to a common rail. In turn, the common rail is connected to a plurality of injectors, each of which is associated with one cylinder of the engine.

In conventional common rail fuel delivery systems the common rail fuel reservoir has an inlet and a plurality of outlets. A supply pipe connects the common rail inlet to the high pressure pump. Each of the plurality of common rail outlets delivers fuel to a respective fuel injector.

Each injector typically comprises a nozzle through which fuel is injected into the corresponding engine cylinder. The flow of fuel through the injector nozzle is controlled by a valve needle which is movable along a primary axis of the injector body and may be lifted from a valve seat adjacent to the nozzle in order to allow fuel to flow through the nozzle for injection into the cylinder.

A plurality of rail-to-injector connecting pipes are used to connect each outlet of the common rail to an inlet of the associated fuel injector. Accordingly, high pressure fuel in the common rail can be supplied to each fuel injector via its respective rail-to-injector connecting pipe.

The rail-to-injector pipes are typically formed from metal in order to withstand the forces exerted by the high pressure fuel flowing through them. Accordingly, the pipes are inflexible. Furthermore, the configuration of each pipe is constrained by the requirement to mitigate the effects of pressure waves propagating therethrough, during engine running. Such pressure waves are undesirable because they can adversely affect the amount of fuel injected during an injection event. Moreover, since the length and configuration of the pipe influences the propagation of pressure waves through it, a degree of uniformity of the pipe design is necessary such that each injector can be controlled according to the same injection strategy, i.e. typically all of the pipes are of equal length such that each one of the fuel injectors has the same pressure-wave characteristics. Additionally, there are constraints on the relative positions between the injectors, the rail and the pipes, which result from the design of the engine bay and the configuration of the engine block.

Due to the above-mentioned constraints, in conventional fuel delivery systems the pipes associated with adjacent fuel injectors overlap with one another such that, during maintenance or replacement of any one particular pipe, it is often necessary to first remove one or more of the other pipes. This increases the time taken for maintenance, and increases the chances of a pipe becoming contaminated with, for example, dust and dirt. Such contamination is highly undesirable since it may affect the flow of fuel to the injectors resulting in reduced engine performance and an increased possibility of engine failure.

It is an object of the present invention to substantially overcome or mitigate the above-mentioned problems associated with conventional fuel delivery systems.

SUMMARY OF INVENTION

According to the present invention, there is provided a fuel delivery system for an internal combustion engine, the system comprising;

a common rail fuel reservoir having a primary rail axis and comprising a plurality of outlets at spaced locations along said rail axis;

a plurality of fuel injectors arranged at spaced locations with respect to said rail axis, each injector comprising an injector inlet, said plurality of fuel injectors being arranged in first and second groups;

first and second groups of pipes, each pipe being of substantially equal length, wherein each of said first group of pipes is of a first common design and connects the injector inlet of one of said first group of fuel injectors to an outlet displaced relative to said one of said first group of fuel injectors in a first direction substantially parallel to said rail axis, and each of said second group of pipes is of a second common design and connects the injector inlet of one of said second group of fuel injectors to an outlet displaced relative to said one of said second group of fuel injectors in a second direction substantially parallel to said rail axis and antiparallel to said first direction;

wherein not more than one of said first group of injectors is disposed adjacent to said second group of injectors.

The present invention provides a fuel delivery system in which all but one of the rail-to-injector connecting pipes can be readily removed without first removing any other connecting pipe such that maintenance time can be reduced and the likelihood of contamination of the connecting pipes is also reduced. Indeed, with a fuel delivery system according to the first aspect of the present invention, it is possible that all of the rail-to-injector pipes may be removed individually without first removing any other connecting pipe. These advantages are provided notwithstanding the fact that all of the pipes are of equal length in order that each one of the plurality of fuel injectors has the same pressure-wave characteristics. Furthermore, only two different types of pipe are required to provide the advantages.

Conveniently, said plurality of fuel injectors are arranged in a line and the distance between end ones of said plurality of outlets is less than the distance between end ones of said plurality of fuel injectors.

Advantageously, said first and second common designs are configured such that, in the case that one of said first group of pipes and one of said second group of pipes are connected to respective adjacent outlets of said common rail, said one of said first group of pipes and said one of said second group of pipes are sufficiently spaced apart so as to prevent contact therebetween during running of said internal combustion engine. Thus, any additional noise caused by pipes vibrating against each other is eliminated.

Preferably, said plurality of fuel injectors are arranged in a line parallel to said rail axis, said line of injectors comprising first and second end injectors, said first end injector being one of said first group of fuel injectors and said second end injector being one of said second group of fuel injectors; and wherein no part of the first pipe connected to said first end injector projects beyond said first end injector in said second direction parallel to said rail axis, and wherein no part of the second pipe connected to said second end injector projects beyond said second end injector in said first direction parallel to said rail axis.

Advantageously, no part of any of said first group of pipes projects beyond the respective fuel injector connected thereto in said second direction parallel to said rail axis, or beyond the respective outlet connected thereto in said first direction parallel to said rail axis.

Conveniently, no part of any of said second group of pipes projects beyond the respective fuel injector connected thereto in said first direction parallel to said rail axis, or beyond the respective outlet connected thereto in said second direction parallel to said rail axis.

Preferably, each fuel injector comprises an injector body which defines an injector body axis and each injector inlet defines an injector inlet axis which extends substantially at right angles to said injector body axis. It is convenient for the respective injector body axis of each injector, the respective injector inlet axis of each injector and the rail axis to be arranged so as to define a set of substantially orthogonal axes.

Preferably, each of said first group of pipes comprises first, second and third portions, said second and third portions being arranged, in use, to convey fuel in a direction substantially parallel to said rail axis and said injector inlet axis, respectively. More preferably, said first portion is arranged, in use, to convey fuel in a direction substantially parallel to said injector body axis. Conveniently, said second portion comprises a meander, or sinuous course.

Preferably, each of said second group of pipes comprises first, second and third portions, said second and third portions being arranged, in use, to convey fuel in a direction substantially parallel to said rail axis and said injector inlet axis, respectively. More preferably, said first portion is arranged, in use, to convey fuel in a direction substantially parallel to said injector body axis.

According to a second aspect of the present invention, there is provided an internal combustion engine comprising a fuel delivery system as described-above. Preferred and/or optional features of the fuel delivery system of the first aspect of the invention are also applicable to the engine of the second aspect of the invention, alone or in appropriate combination.

Preferably, the engine comprises at least three mounting means for coupling said rail to an engine block, said three mounting means being disposed at spaced apart locations with respect to the rail axis.

According to a third aspect of the present invention, there is provided a fuel delivery system for an internal combustion engine, the system comprising;

a common rail fuel reservoir having a primary rail axis and comprising a plurality of outlets at spaced locations along said rail axis;

a plurality of fuel injectors arranged at spaced locations with respect to said rail axis, each injector comprising an injector inlet, said plurality of fuel injectors comprising first and second groups;

first and second groups of pipes, each pipe being of substantially equal length, wherein each of said first group of pipes connects the injector inlet of one of said first group of fuel injectors to an outlet displaced relative to said one of said first group of fuel injectors in a first direction substantially parallel to said rail axis, and each of said second group of pipes connects the injector inlet of one of said second group of fuel injectors to an outlet displaced relative to said one of said second group of fuel injectors in a second direction substantially parallel to said rail axis and antiparallel to said first direction;

wherein not more than one of said first group of fuel injectors is disposed adjacent to said second group of fuel injectors;

wherein said plurality of fuel injectors are arranged in a line parallel to said rail axis, said line of injectors comprising first and second end injectors, said first end injector being one of said first group of fuel injectors and said second end injector being one of said second group of fuel injectors; and wherein no part of the first pipe connected to said first end injector projects beyond said first end injector in said second direction parallel to said rail axis, and wherein no part of the second pipe connected to said second end injector projects beyond said second end injector in said first direction parallel to said rail axis.

Advantageously, no part of any of said first group of pipes projects beyond the respective fuel injector connected thereto in said second direction parallel to said rail axis, or beyond the respective outlet connected thereto in said first direction parallel to said rail axis.

Advantageously, no part of any of said second group of pipes projects beyond the respective fuel injector connected thereto in said first direction parallel to said rail axis, or beyond the respective outlet connected thereto in said second direction parallel to said rail axis.

According to a fourth aspect of the present invention, there is provided a fuel delivery system for an internal combustion engine, the system comprising;

a common rail fuel reservoir having a primary rail axis and comprising a plurality of outlets at spaced locations along said rail axis;

a plurality of fuel injectors arranged at spaced locations with respect to said rail axis, each injector comprising an injector inlet, said plurality of fuel injectors comprising first and second groups;

first and second groups of pipes, each pipe being of substantially equal length, wherein each of said first group of pipes is of a first common design and connects the injector inlet of one of said first group of fuel injectors to an outlet displaced relative to said one of said first group of fuel injectors in a first direction substantially parallel to said rail axis, and each of said second group of pipes is of a second common design and connects the injector inlet of one of said second group of fuel injectors to an outlet displaced relative to said one of said second group of fuel injectors in a second direction substantially parallel to said rail axis and antiparallel to said first direction;

wherein not more than one of said first group of fuel injectors is disposed adjacent to said second group of fuel injectors; and wherein no part of any of said first group of pipes projects beyond the respective fuel injector connected thereto in said second direction parallel to said rail axis, or beyond the respective outlet connected thereto in said first direction parallel to said rail axis.

Advantageously, no part of any of said second group of pipes projects beyond the respective fuel injector connected thereto in said first direction parallel to said rail axis, or beyond the respective outlet connected thereto in said second direction parallel to said rail axis.

BRIEF DESCRIPTION OF THE DRAWINGS

An embodiment of the present invention will now be described, by way of example only, with reference to the accompanying drawings, in which.

DETAILED DESCRIPTION OF THE PREFERRED EMBODIMENTS

Figure 1:
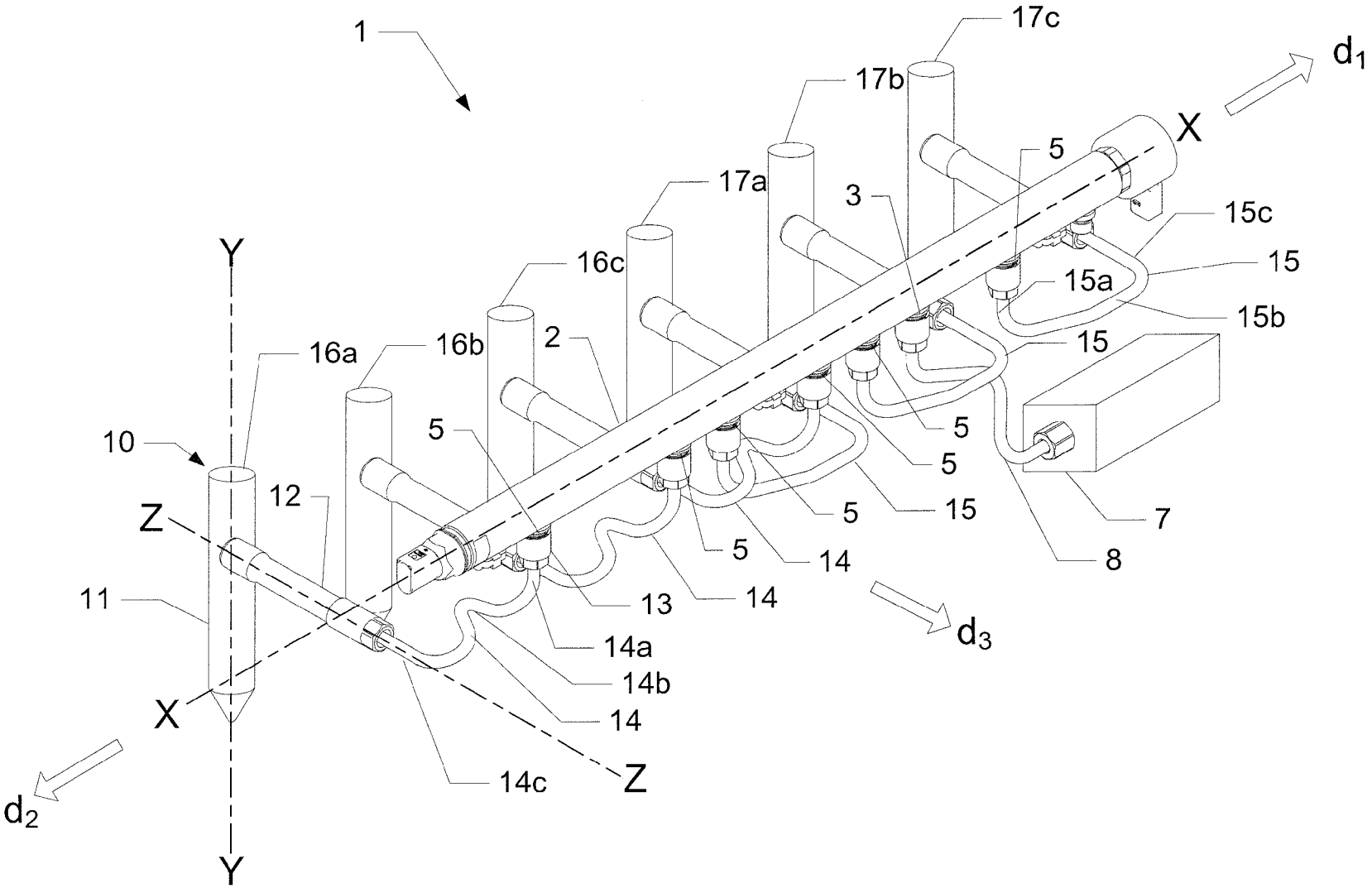
FIG. 1 shows an embodiment of a fuel delivery system for a compression-ignition internal combustion engine according to the present invention.

Referring to FIG. 1, the fuel delivery system 1 comprises a common rail fuel reservoir 2 having an inlet 3 and a plurality of outlets 5. The common rail 2 comprises a generally cylindrical body with an axial cavity formed therein which defines a primary rail axis X-X.

A high pressure fuel pump 7 supplies high pressure fuel to the common rail 2 via a supply pipe 8, which connects the outlet of the pump 7 to the inlet 3 of the common rail 2.

Figure 4:
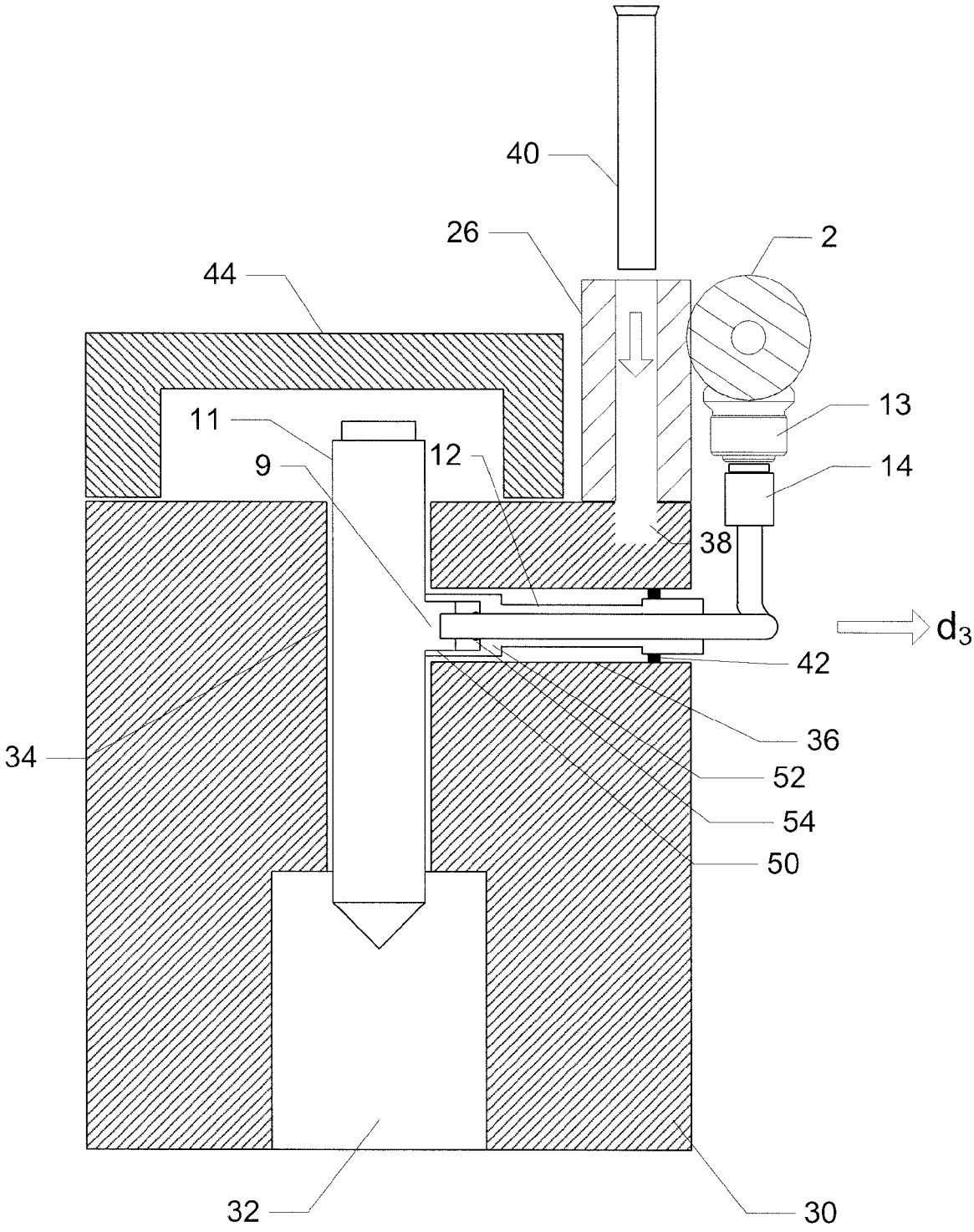
FIG. 4 is a sectional view of an engine comprising the fuel delivery system of FIG. 1 and the mounting element of FIGS. 2 and 3.

Each of the plurality of common rail outlets 5 is associated with one of a plurality of fuel injectors 10. Each injector 10 comprises an injector body 11 having an inlet 9, as shown in FIG. 4.

The injector body 11 is an elongate member having a generally circular cross section, which defines a primary injector body axis Y-Y coaxial therewith.

A plurality of rail-to-injector connecting pipes 14, 15 connect each outlet 5 of the common rail 2 to an inlet portion 9 of a respective one of the injectors 10. Each rail-to-injector pipe 14, 15 comprises fixing means 13 at a first end thereof to attach each first end of the pipe 14, 15 to a respective one of the outlets 5. In one embodiment, the fixing means 13 comprises an internally threaded collar which cooperates with an external thread provided on the respective common rail outlet 5.

A plurality of injector inlet connectors 12 connect respective second ends of each pipe 14, 15 to the inlet 9 of respective ones of the injectors 10. Each inlet connector 12 comprises a hollow, generally cylindrical body arranged to receive the second end of the pipe 14, 15. As can be seen in FIG. 4, a first end of the inlet connector 12 comprises an internally threaded portion 50 and a reduced diameter portion 52. The internally threaded portion 50 cooperates with an external thread provided on the injector inlet 9 to attach the inlet connector 12 thereto.

The respective second ends of each pipe 14, 15 are provided with a projection 54 on the outer surface thereof, which extends around the circumference of the pipe 14, 15. The reduced diameter portion 52 of each inlet connector 12 abuts against the associated projection 54, such that, when the inlet connector 12 is attached to the injector inlet 9, the reduced diameter portion 52 presses against the projection 54 so that the second end of the pipe 14, 15 makes a fluid tight seal with the injector inlet 9.

The injector inlet 9 is arranged such that when the inlet connector 12 is attached thereto, the inlet connector 12 extends perpendicularly to the injector body 11. Thus, the injector inlet 9 defines a primary injector inlet axis Z-Z perpendicular to the injector body axis Y-Y. Furthermore, the injector body axis Y-Y and the injector inlet axis Z-Z are both perpendicular to the rail axis X-X.

The plurality of rail-to-injector pipes comprise first and second groups of pipes 14, 15. Each pipe of the first and the second groups of pipes 14, 15 is designed to be of equal length such that each one of the fuel injectors 10 and its associated pipe 14, 15 have the same pressure-wave characteristics. However, the first and second groups of pipes 14, 15 have different configurations as will be described in more detail below.

Each pipe of the first group of pipes 14 is of a first common design and comprises a first, a second and a third portions 14*a*, 14*b*, 14*c*. The first section 14*a* extends in a direction substantially parallel to the injector body axis Y-Y. The second section 14*b* is generally aligned with, or follows the line of the rail axis X-X but comprises a meander, or sinuous course. The third section 14*c* extends in a direction substantially parallel to the injector inlet axis Z-Z.

Each pipe of the second group of pipes 15 is of a second common design and comprises a first portion 15*a* which extends in a direction substantially parallel to the injector body axis Y-Y, a second portion 15*b* which extends in a direction substantially parallel to the rail axis X-X and a third portion 14*c* which extends in a direction substantially parallel to the injector inlet axis Z-Z.

The first and second groups of pipes 14, 15 connect to respective first and second groups of fuel injectors 16*a*, 16*b*, 16*c*, 17*a*, 17*b*, 17*c*. Specifically, each one of the first group of injectors 16*a*, 16*b*, 16*c* is connected to a respective outlet 5 of the common rail 2 by one of the first group of pipes 14 and, each one of the second group of injectors 17*a*, 17*b*, 17*c* is connected to a respective outlet 5 of the common rail 2 by one of the second group of pipes 15.

The plurality of injectors 10 are arranged in a line, parallel to the rail axis X-X, with the first group of injectors 16*a*, 16*b*, 16*c* disposed adjacent to the second group of injectors 17*a*, 17*b*, 17*c*. Accordingly, with this configuration, only one injector 16*c* of the first group of injectors is disposed adjacent to an injector 17*a* of the second group of injectors. Each one of the injectors 10 is spaced apart from the common rail 2 in a direction parallel to the injector inlet axis Z-Z.

Each of the first group of injectors 16*a*, 16*b*, 16*c* is connected to an outlet 5 which is displaced therefrom in a direction $d_1$ parallel to the rail axis X-X. Each of the second group of injectors 17*a*, 17*b*, 17*c* is connected to an outlet 5 which is displaced therefrom in a direction $d_2$ parallel to the rail axis X-X, the direction $d_2$ being opposite to the direction $d_1$.

In FIG. 1, the arrow labelled $d_1$ indicates the direction along the rail axis X-X in which the respective outlets 5 of the first group of injectors 16*a*, 16*b*, 16*c* are displaced relative to each of the first group of injectors 16*a*, 16*b*, 16*c*. Similarly, the arrow labelled $d_2$ indicates the direction along the rail axis X-X in which the respective outlets 5 of the second group of injectors 17*a*, 17*b*, 17*c* are displaced relative to each of the second group of injectors 17*a*, 17*b*, 17*c*. The direction $d_1$ is antiparallel or opposite to the direction $d_2$.

Figure 2:
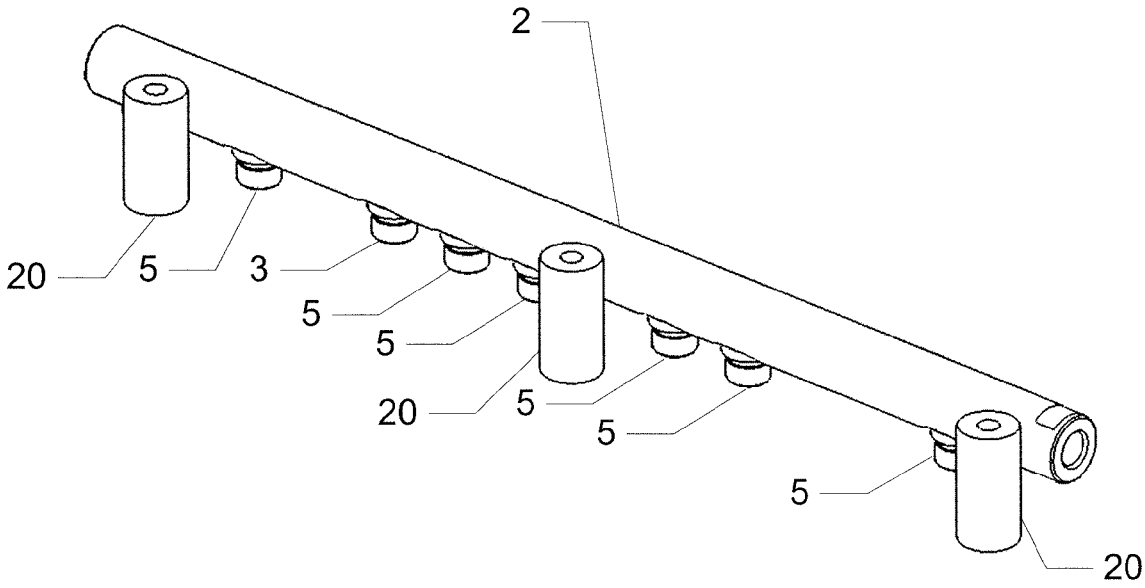
FIG. 2 is a perspective view of a mounting arrangement for the common rail of the fuel delivery system in FIG. 1.

Referring to FIG. 2, the common rail 2 is attached to an engine assembly by a plurality of mounting means 20. The plurality of mounting means 20 are arranged at spaced apart locations along the length of the common rail 2.

Figure 3:
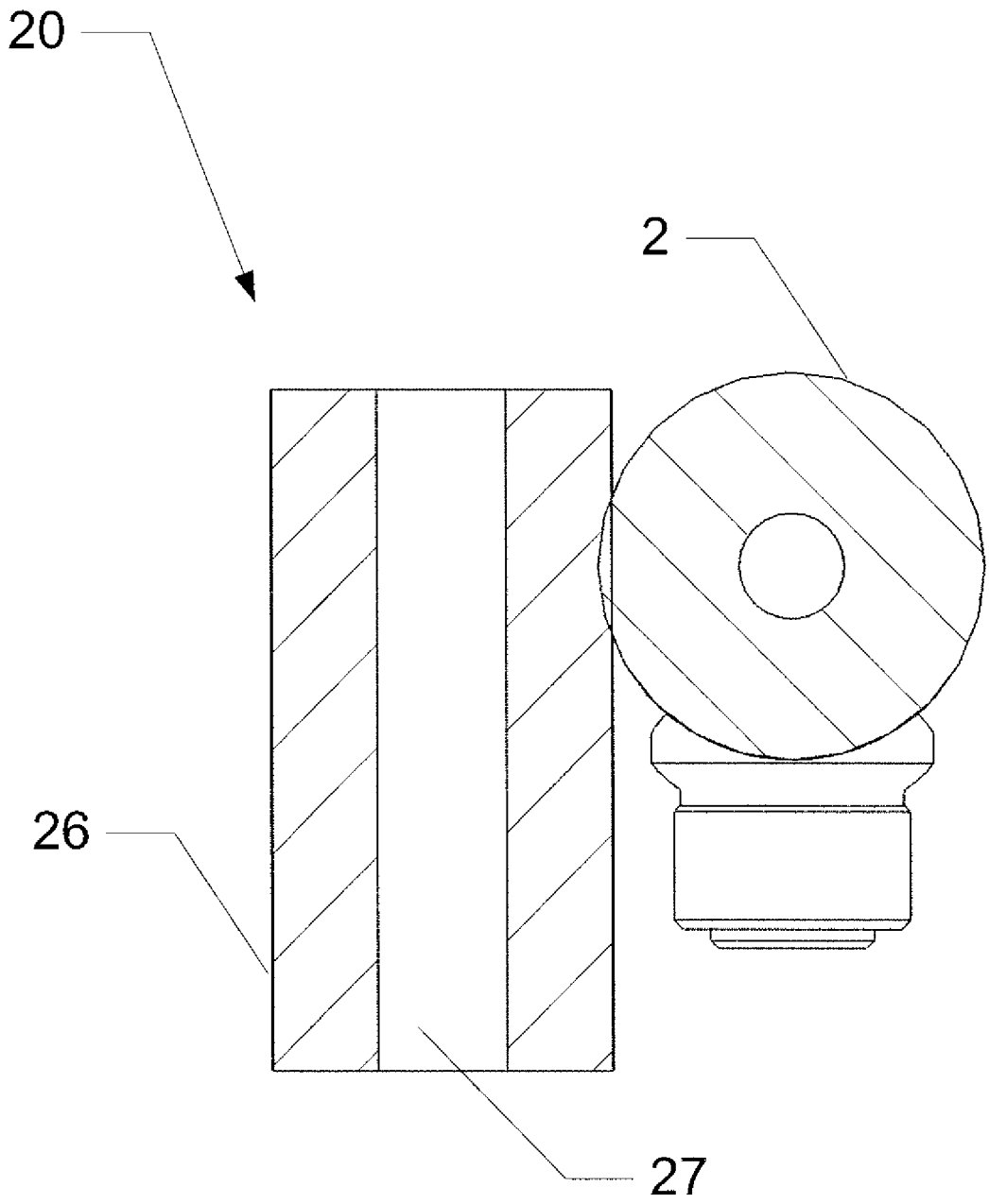
FIG. 3 is an approximate sectional view of a mounting element of the arrangement of FIG. 2.

Referring to FIG. 3, each mounting means 20 comprises a spacing element 26, which is a hollow cylindrical member having an axial through bore 27.

The attachment of the common rail 2 to an engine assembly will now be described.

Referring to FIG. 4, an engine assembly comprises an engine block 30 comprising a combustion chamber 32. A first bore 34 is formed through the engine block 30 for receiving the fuel injector body 11. The first bore 34 opens into the upper end of the combustion chamber 32 such that, when a fuel injector body 11 is installed therein, an outlet end of the fuel injector 10 is disposed so as to inject fuel into the combustion chamber 32.

A second bore 36 is formed in a side of the engine block 30 and intersects the first bore 34 at right angles. During installation, the injector body 11 is inserted into the first bore 34 and oriented such that the inlet 9 thereof is aligned with the second bore 36.

It will be appreciated that whilst FIG. 4 is a sectional view and shows only a single combustion chamber 32, the engine block 30 comprises an equivalent number of combustion chambers 32 to the number of injectors 10 shown in FIG. 1.

A plurality of bolt holes 38 are formed in the upper surface of the engine block 30 at spaced locations in the direction of the rail axis X-X.

In order to attach the common rail 2 to the engine block 30, the spacing element 26 of each of the mounting means 20 is first attached to the common rail 2 (e.g. by welding) such that the spacing between the axial bores 27 of each of the spacing elements 26 along the rail 2 corresponds to the spacing between the bolt holes 38 on the engine block 30.

Next, the rail 2 is positioned such that the axial bore 27 of each spacing element 26, is co-axial with each of the respective bolt holes 38. The common rail 2 may then be fixed to the engine block 30 by passing a bolt 40 through the axial bore 27 of each spacing element 26, and securing them within each bolt hole 38.

Since the height of the rail 2 above the engine block 30 is determined by the length of the respective spacing elements 26, it is easy to adjust the height at which the rail 2 is mounted simply by using spacing elements 26 of different lengths. The increased height of the common rail 2 above the engine block 30 resulting from the use of the spacing elements 26 facilitates the removal and installation of the rail-to-injector pipes 14, 15.

Furthermore, in the presently described embodiment, the use of three spacing elements 26 improves the rigidity with which the rail 2 is attached to the engine block 30. In particular, using three spacing elements 26 provides a higher first modal frequency than the case where only two spacing elements 26 are employed. Accordingly, the lifetime of the weld between each spacing element 26 and the rail is extended. Additionally, each spacing element 26 can readily be welded to the rail 2 at a position on the rail 2 which corresponds to the strongest mounting point on the engine block 30.

When the rail 2 has been attached to the engine block 30, the outlets 5 of the rail 2 are connected to the inlets 9 of the respective injectors 10 by means of the rail-to-injector pipes 14, 15. Each pipe 14, 15 is connected to an injector body 11 by inserting the second end of the pipe 14, 15, together with the inlet connector 12, into the second bore 36 of the engine block 30. As described previously, when the inlet connector 12 is attached to the injector inlet 9, the reduced diameter portion 52 presses against the projection 54 so that the second end of the pipe 14, 15 makes a fluid tight seal with the injector inlet 9. A rubber seal 42 is provided around the circumference of the inlet connector 12 in order to provide a fluid tight seal with the surface of the second bore 36.

The first end of the pipe 14, 15 is attached to an outlet 5 of the common rail 2 using the fixing means 13. Finally, an engine cover 44 is attached to the top of the engine block 30 to protect the injectors 10.

As shown in FIG. 4, the installation and removal of the rail-to-injector pipes 14, 15, is constrained by the shape of the engine block 30 and the relative positions of the rail outlets 5 and the inlet connectors 12. In particular, once the rail 2 has been attached to the engine block 30, in order to remove a rail-to-injector pipe 14, 15 it is necessary to move the pipe in a direction $d_3$ until the pipe is unobstructed by the rail 2 or the engine block 30.

Due to the spacing between the injectors 10 and the respective configurations of the first and second groups of pipes 14, 15, in the case that an injector 16*c* of the first group of injectors is disposed adjacent to an injector 17*a* of the second group of injectors, the respective rail-to-injector pipes 14, 15 overlap with one another in a direction parallel to the rail axis X-X. More specifically, the second portion 14*b* of the first pipe 14 partly surrounds the first portion 15*a* of the second pipe 15. In order to remove the second pipe 15 from the injector 17*a*, it is necessary to first remove the first pipe 14 from the injector 16*c*. However, due to the fact that only one of the first group of injectors 16*c* is adjacent to an injector of the second group of injectors 17*a*, there is only a single overlap of the first and second groups of rail-to-injector pipes 14, 15 along the entire length of the common rail 2. Thus, the rail-to-injector pipes of each of the injectors 16*a*, 16*b*, 16*c*, 17*b*, 17*c* can be removed without the need to first remove any other rail-to-injector pipe.

The above described arrangement thus provides the advantage that maintenance time can be reduced by reducing the number of operations required, i.e. the number of pipes which must be removed. Furthermore, the likelihood of contamination of the rail-to-injector pipes is also reduced. These advantages are provided notwithstanding the fact that only two distinct configurations of connecting pipe are employed, each pipe being configured so as to mitigate the adverse effects of pressure waves propagating therethrough.

Furthermore, by only employing two different designs of rail-to-injector pipe, manufacturing costs may be reduced. Additionally, each of the first group of pipes 14 are interchangeable with one another. Similarly, each of the second group of pipes 15 are interchangeable with one another.

It will be appreciated by the skilled person that, depending on the configuration of the engine block to which the above-described fuel delivery system is mounted, it is possible that each of the rail-to-injector pipes may be removed individually.

Additionally, it will be appreciated by the skilled person that, due to manufacturing tolerances, the rail axis X-X, the injector body axis Y-Y and the injector inlet axis Z-Z may not be precisely orthogonal to one another.

Furthermore, it will be appreciated by the skilled person that the respective first portions 14*a*, 15*a* of the first and second pipes 14, 15 need not be substantially parallel to the injector body axis Y-Y. Rather, the first portion 14*a*, 15*a* could extend at an angle to the injector body axis Y-Y of, for example, 30 or 45 degrees. In particular, this may be the case if the outlets 5 of the common rail 2 project at a corresponding angle to the injector body axis Y-Y.

Moreover, it will be appreciated by the skilled person that the rail 2 may be attached to the engine block 30 by means of only two spacing elements 26 or, alternatively, by more than three spacing elements 26.

It will further be appreciated by the skilled person that, whilst the fuel delivery system of the above-described embodiment is adapted for use with a 6-cylinder engine, the present invention may equally be applied to engines comprising more than two cylinders. The invention is also applicable to engines other than diesel injection engines (e.g. gasoline injection engines).

It will be understood that the embodiments described above are given by way of example only and are not intended to limit the invention, the scope of which is defined in the appended claims.

The invention claimed is:

1. A fuel delivery system for an internal combustion engine, the system comprising;

a common rail fuel reservoir having a primary rail axis and comprising a plurality of outlets at spaced locations along said rail axis;

a plurality of fuel injectors arranged at spaced locations with respect to said rail axis, each injector comprising an injector inlet, said plurality of fuel injectors comprising first and second groups;

first and second groups of pipes, each pipe being of substantially equal length, wherein each of said first group of pipes is of a first common design and connects the injector inlet of one of said first group of fuel injectors to an outlet displaced relative to said one of said first group of fuel injectors in a first direction substantially parallel to said rail axis, and each of said second group of pipes is of a second common design and connects the injector inlet of one of said second group of fuel injectors to an outlet displaced relative to said one of said second group of fuel injectors in a second direction substantially parallel to said rail axis and antiparallel to said first direction;

wherein not more than one of said first group of fuel injectors is disposed adjacent to said second group of fuel injectors.

2. A system according to claim 1, wherein said plurality of fuel injectors are arranged in a line and the distance between end ones of said plurality of outlets is less than the distance between end ones of said plurality of fuel injectors.

3. A system according to claim 1, said first and second common designs being configured such that, in the case that one of said first group of pipes and one of said second group of pipes are connected to respective adjacent outlets of said common rail, said one of said first group of pipes and said one of said second group of pipes are sufficiently spaced apart so as to prevent contact therebetween during running of said internal combustion engine.

4. A system according to claim 1, wherein said plurality of fuel injectors are arranged in a line parallel to said rail axis, said line of injectors comprising first and second end injectors, said first end injector being one of said first group of fuel injectors and said second end injector being one of said second group of fuel injectors;

wherein no part of the one of said first group of pipes connected to said first end injector projects beyond said first end injector in said second direction parallel to said rail axis, and wherein no part of the one of said second group of pipes connected to said second end injector projects beyond said second end injector in said first direction parallel to said rail axis.

5. A system according to claim 1, wherein no part of any of said first group of pipes projects beyond the respective fuel injector connected thereto in said second direction parallel to said rail axis, or beyond the respective outlet connected thereto in said first direction parallel to said rail axis.

6. A system according to claim 1, wherein no part of any of said second group of pipes projects beyond the respective fuel injector connected thereto in said first direction parallel to said rail axis, or beyond the respective outlet connected thereto in said second direction parallel to said rail axis.

7. A system according to claim 1, wherein each fuel injector comprises a body which defines an injector body axis and each respective injector inlet defines an injector inlet axis which extends substantially at right angles to said injector body axis.

8. A system according to claim 7, wherein the respective injector body axis of each injector, the respective injector inlet axis of each injector and the rail axis define a set of substantially orthogonal axes.

9. A system according to claim 7, wherein each of said first group of pipes comprises first, second and third portions, said second and third portions being adapted to convey fuel in a direction substantially parallel to said rail axis and said injector inlet axis, respectively.

10. A system according to claim 9, wherein said first portion is adapted to convey fuel in a direction substantially parallel to said injector body axis.

11. A system according to claim 9, wherein said second portion is adapted to convey fuel in a sinuous course.

12. A system according to claim 7, wherein each of said second group of pipes comprises first, second and third portions, said second and third portions being arranged, in use, to convey fuel in a direction substantially parallel to said rail axis and said injector inlet axis, respectively.

13. A system according to claim 12, wherein said first portion is arranged, in use, to convey fuel in a direction substantially parallel to said injector body axis.

14. A fuel delivery system for an internal combustion engine, the system comprising;

a common rail fuel reservoir having a primary rail axis and comprising a plurality of outlets at spaced locations along said rail axis;

a plurality of fuel injectors arranged at spaced locations with respect to said rail axis, each injector comprising an injector inlet, said plurality of fuel injectors comprising first and second groups;

first and second groups of pipes, each pipe being of substantially equal length, wherein each of said first group of pipes connects the injector inlet of one of said first group of fuel injectors to an outlet displaced relative to said one of said first group of fuel injectors in a first direction substantially parallel to said rail axis, and each of said second group of pipes connects the injector inlet of one of said second group of fuel injectors to an outlet displaced relative to said one of said second group of fuel injectors in a second direction substantially parallel to said rail axis and antiparallel to said first direction;

wherein not more than one of said first group of fuel injectors is disposed adjacent to said second group of fuel injectors;

wherein said plurality of fuel injectors are arranged in a line parallel to said rail axis, said line of injectors comprising first and second end injectors, said first end injector being one of said first group of fuel injectors and said second end injector being one of said second group of fuel injectors; and wherein no part of the first pipe connected to said first end injector projects beyond said first end injector in said second direction parallel to said rail axis, and wherein no part of the second pipe connected to said second end injector projects beyond said second end injector in said first direction parallel to said rail axis.

15. A system according to claim 14, wherein no part of any of said first group of pipes projects beyond the respective fuel injector connected thereto in said second direction parallel to said rail axis, or beyond the respective outlet connected thereto in said first direction parallel to said rail axis.

16. A system according to claim 14, wherein no part of any of said second group of pipes projects beyond the respective fuel injector connected thereto in said first direction parallel to said rail axis, or beyond the respective outlet connected thereto in said second direction parallel to said rail axis.

17. A fuel delivery system for an internal combustion engine, the system comprising;

a common rail fuel reservoir having a primary rail axis and comprising a plurality of outlets at spaced locations along said rail axis;

a plurality of fuel injectors arranged at spaced locations with respect to said rail axis, each injector comprising an injector inlet, said plurality of fuel injectors comprising first and second groups;

first and second groups of pipes, each pipe being of substantially equal length, wherein each of said first group of pipes is of a first common design and connects the injector inlet of one of said first group of fuel injectors to an outlet displaced relative to said one of said first group of fuel injectors in a first direction substantially parallel to said rail axis, and each of said second group of pipes is of a second common design and connects the injector inlet of one of said second group of fuel injectors to an outlet displaced relative to said one of said second group of fuel injectors in a second direction substantially parallel to said rail axis and antiparallel to said first direction;

wherein not more than one of said first group of fuel injectors is disposed adjacent to said second group of fuel injectors; and wherein no part of any of said first group of pipes projects beyond the respective fuel injector connected thereto in said second direction parallel to said rail axis, or beyond the respective outlet connected thereto in said first direction parallel to said rail axis.

18. A system according to claim 17, wherein no part of any of said second group of pipes projects beyond the respective fuel injector connected thereto in said first direction parallel to said rail axis, or beyond the respective outlet connected thereto in said second direction parallel to said rail axis.

* * * * *